US006848660B2

(12) United States Patent
Jackson

(10) Patent No.: US 6,848,660 B2
(45) Date of Patent: Feb. 1, 2005

(54) APPARATUS FOR DISPLAYING ORNAMENTAL OBJECTS

(76) Inventor: Jeffrey Jackson, 6128 Suffex Green La., Atlanta, GA (US) 30339

( * ) Notice: Subject to any disclaimer, the term of this patent is extended or adjusted under 35 U.S.C. 154(b) by 0 days.

(21) Appl. No.: 10/346,153

(22) Filed: Jan. 16, 2003

(65) Prior Publication Data

US 2004/0140408 A1 Jul. 22, 2004

(51) Int. Cl.[7] ..... A47B 29/00
(52) U.S. Cl. ..... 248/215; 211/13.1; 248/316.7
(58) Field of Search ..... 248/215, 214, 248/316.1, 316.7, 322, 339, 231.81, 74.1, 74.2, 74.3, 497, 498, 62; 211/22, 131

(56) References Cited

U.S. PATENT DOCUMENTS

| | | | | | |
|---|---|---|---|---|---|
| 514,222 | A | | 2/1894 | Hall | 248/231.1 |
| 1,496,388 | A | | 6/1924 | Stern | 248/489 |
| 1,501,807 | A | * | 7/1924 | Petschel | 211/30 |
| 1,566,982 | A | * | 12/1925 | Shee | 248/214 |
| 1,726,316 | A | * | 8/1929 | Saxton | 248/215 |
| 1,943,261 | A | | 1/1934 | Knutson | 24/73 |
| 2,080,990 | A | * | 5/1937 | Weekley | 248/215 |
| 2,461,071 | A | | 2/1949 | Mettenleiter | 248/227 |
| 2,472,058 | A | * | 6/1949 | Artley | 211/13.1 |
| 2,565,719 | A | | 8/1951 | Church | 248/215 |
| 3,136,515 | A | * | 6/1964 | Potruch | 248/62 |
| 3,260,489 | A | | 7/1966 | Hentzi | 248/215 |
| D255,774 | S | | 7/1980 | Soucy | D8/371 |
| 4,418,496 | A | | 12/1983 | Koistinen | 47/41.12 |
| 4,667,910 | A | | 5/1987 | Atterby et al. | 248/71 |
| 4,739,582 | A | | 4/1988 | Cullinane | 47/41.12 |
| D300,792 | S | | 4/1989 | Hutchins | D6/512 |
| 4,880,133 | A | | 11/1989 | Cullinane | 220/85 H |
| 4,887,785 | A | | 12/1989 | Blaich | 248/339 |
| 4,979,712 | A | | 12/1990 | Rios | 248/215 |
| D353,790 | S | | 12/1994 | Emalfarb et al. | D11/155 |
| 5,487,517 | A | | 1/1996 | Smith | 248/215 |
| 5,613,656 | A | * | 3/1997 | Protz, Jr. | 248/74.2 |
| D447,936 | S | | 9/2001 | Kacines | D8/394 |
| 6,311,851 | B1 | * | 11/2001 | Knudsen et al. | 211/13.1 |
| 6,364,260 | B1 | * | 4/2002 | Lorincz et al. | 248/215 |
| 6,378,827 | B1 | | 4/2002 | Kacines | 248/231.81 |
| 6,543,737 | B2 | * | 4/2003 | Decker et al. | 248/316.1 |
| 6,601,809 | B1 | * | 8/2003 | Gebrara | 248/229.16 |

* cited by examiner

*Primary Examiner*—Leslie A. Braun
*Assistant Examiner*—Tan Le
(74) *Attorney, Agent, or Firm*—Hayes Soloway PC

(57) ABSTRACT

An apparatus for displaying an object on a structure is provided. Generally, the structure of the apparatus contains a holding portion that is fabricated so as to allow the apparatus to hold the structure. The apparatus also contains a hook portion that is capable of allowing the object to be set thereon, and a central loop portion that is capable of allowing a second object to be situated therein.

12 Claims, 8 Drawing Sheets

APPARATUS FOR DISPLAYING ORNAMENTAL OBJECTS

FIELD OF THE INVENTION

The present invention generally relates to an apparatus for displaying objects. More specifically, the invention is related to an apparatus for hanging objects from a ledge such as, but not limited to, a banister.

BACKGROUND OF THE INVENTION

Typically, each year during the holiday season festive decorations are arranged on structures such as Christmas trees, fireplace mantles, and banisters. Typical methods used for arranging decorations on structures include the use of adhesive tape and fasteners, such as metallic ties.

As an example, when hanging garland from a banister, adhesive tape is typically used to wrap the garland and prevent displacement of the garland. When using adhesive tape, a piece of adhesive tape is cut and the garland is stuck to the banister by wrapping the adhesive tape around the banister with the garland there between. Unfortunately, removal of the adhesive tape and garland is tedious since the adhesive tape sticks to the banister. Therefore, when removing the adhesive tape and garland, the adhesive tape may damage a banister made of wood or a painted metal banister by pulling a finished coating off of the banister. In addition, the adhesive tape also tends to stick to the garland, thereby resulting in a portion of the garland being removed with removal of the adhesive tape.

FIG. 1 is a schematic diagram illustrating garland 10 set upon a banister 12 via use of adhesive tape 14. As shown by FIG. 1, the adhesive tape 14 is wrapped around the banister 12 to hold the garland 10 in place on the banister 12. Of course, less adhesive tape 14 may be utilized so that the adhesive tape 14 is not wrapped entirely around the banister 12. Even if the adhesive tape 14 is not entirely wrapped around the banister 12, removal of the adhesive tape 14 from the banister 12 still may cause damage to a coating utilized on the banister 12.

Unfortunately, the use of fasteners is quite tedious since fasteners are typically tied or placed every few feet to secure the garland 10 and provide an ornamental design. FIG. 2 is a schematic diagram illustrating garland 10 set upon a banister 12 via use of ties 20, such as metallic ties or plastic ties. As shown by FIG. 2, the tie 20 is wrapped around the banister 12 to hold the garland 10 in place on the banister 12. As mentioned above, an individual setting the garland 10 is encumbered by having to tie the garland 10 with a tie 20 every few feet. Setting the garland 10 on the banister 12 typically includes placing the garland 10 on the banister 12 in a desired arrangement and wrapping the tie 20 around the banister 12 to hold the garland 10 in place. When removing the garland 10 from the banister 12, the individual is required to find each individual tie 20 and unwrap each tie 20 prior to removal of the garland 10 from the banister 12.

Therefore, present systems for setting decorations on structures are tedious and potentially damaging to the structures on which the decorations are set upon.

SUMMARY OF THE INVENTION

Embodiments of the present invention provide an apparatus for displaying ornamental objects. Briefly described, in architecture, one embodiment of the apparatus, among others, can be implemented as follows. The apparatus contains a holding portion that is fabricated so as to allow the apparatus to hold a structure. The apparatus also contains a hook portion that is capable of allowing the object to be set thereon, and a central loop portion that is capable of allowing a second object to be situated therein.

Other apparatuses and advantages of the present invention will be or become apparent to one with skill in the art upon examination of the following drawings and detailed description. It is intended that all such additional apparatuses and advantages be included within this description, be within the scope of the present invention, and be protected by the accompanying claims.

BRIED DESCRIPTION OF THE DRAWINGS

The present invention will be more fully understood from the detailed description given below and from the accompanying drawing of the embodiments of the invention, which however, should not be taken to limit the invention to the specific embodiments enumerated, but are for explanation and for better understanding only. Furthermore, the drawings are not necessarily to scale, emphasis instead being placed upon clearly illustrating the principles of the invention. Finally, like reference numerals in the figures designate corresponding parts throughout the several drawings.

DETAILED DESCRIPTION

It should be noted that while the following describes arrangement of the present clip for hanging ornamental objects (hereafter referred to as, "the clip") on a banister, the clip may be set upon other surfaces such as, but not limited to, a ledge, fireplace molding, chair molding, or any other surface for which the clip is conformed during fabrication. Conforming of the clip is further described below.

Figure 1:
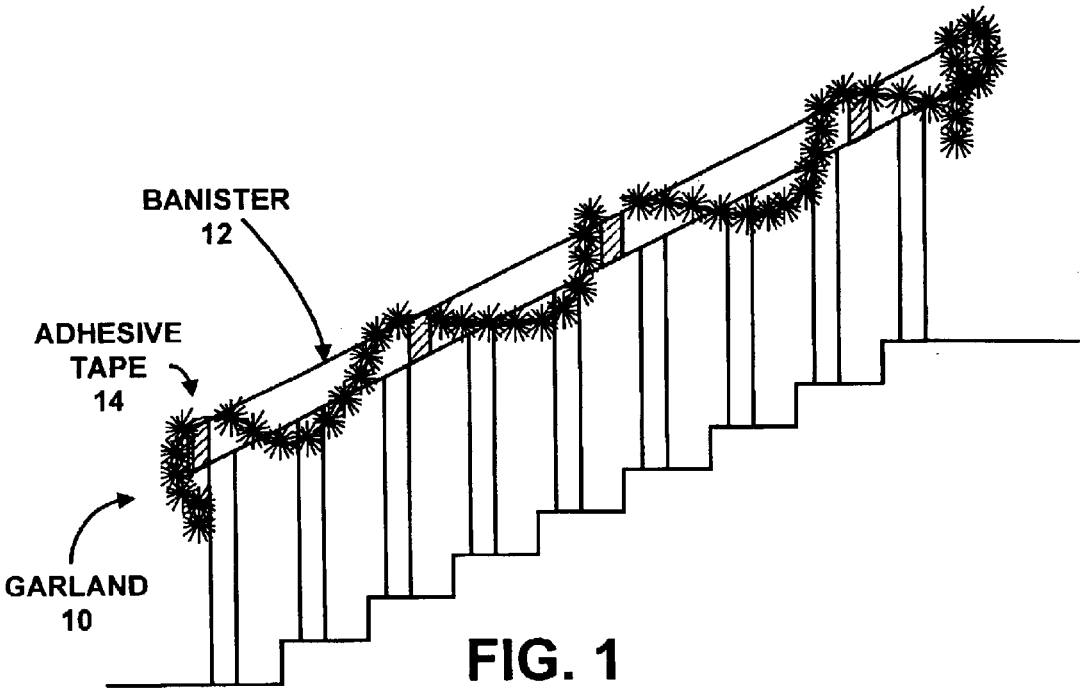
FIG. 1 (PRIOR ART)
FIG. 1 is a schematic diagram illustrating garland set upon a banister via use of adhesive tape, in accordance with the prior art.
Figure 2:
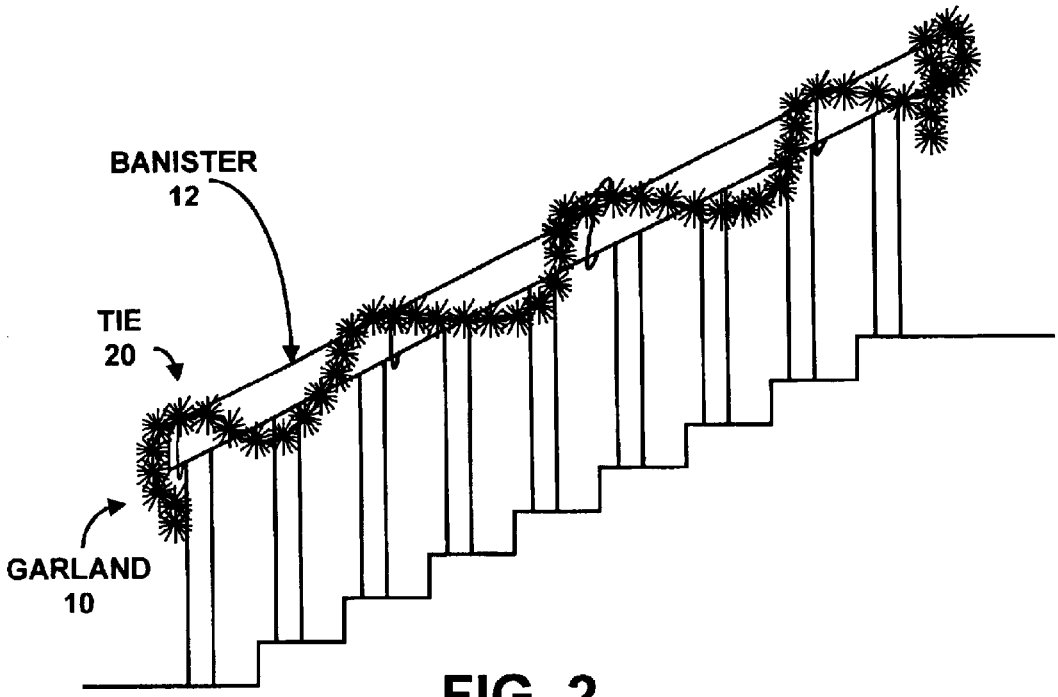
FIG. 2 (PRIOR ART)
FIG. 2 is a schematic diagram illustrating garland set upon a banister via use of ties, in accordance with the prior art.
Figure 3:
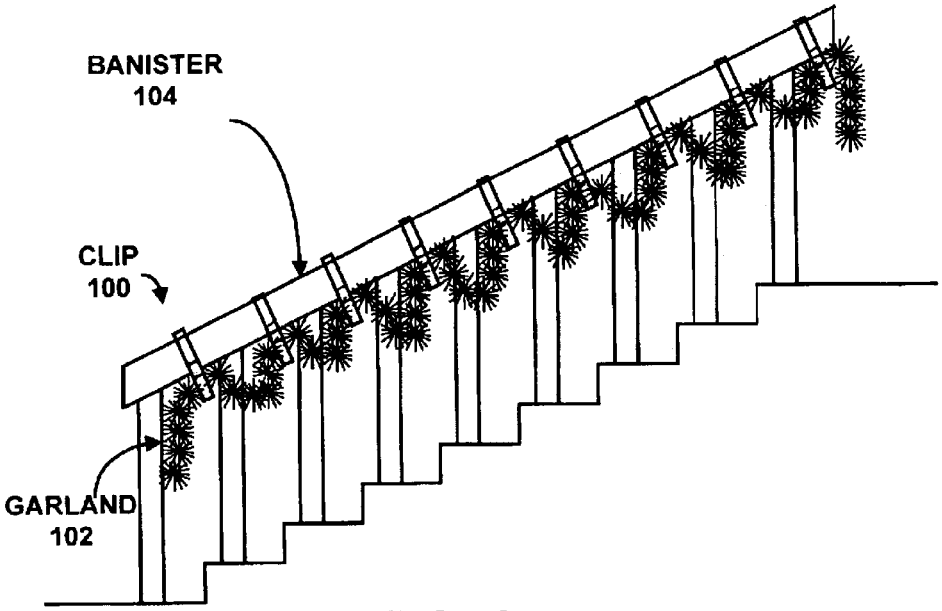
FIG. 3 is a schematic diagram illustrating garland set upon a banister via use of a clip, in accordance with a first exemplary embodiment of the invention.

Referring now to the drawings, wherein like reference numerals designate corresponding parts throughout the drawings, FIG. 3 is a schematic diagram illustrating use of the clip 100 for arranging garland 102 on a banister 104. It should be noted that the clip 100 may be utilized to arrange other objects as well, such as, but not limited to, ornaments, lights (described below), and bows (described below). For exemplary purposes, the present detailed description describes arranging of garland 102 on a banister 104.

As is shown by FIG. 3, the garland 102 hangs from the clip 100, while the clip 100 is set on the banister 104. In accordance with a first exemplary embodiment of the invention, the garland 102 hangs from a hook portion 122 (FIG. 6) of the clip 100 (described below). To change hanging arrangement of the garland 102, additional or fewer clips 100 may be utilized.

Figure 4:
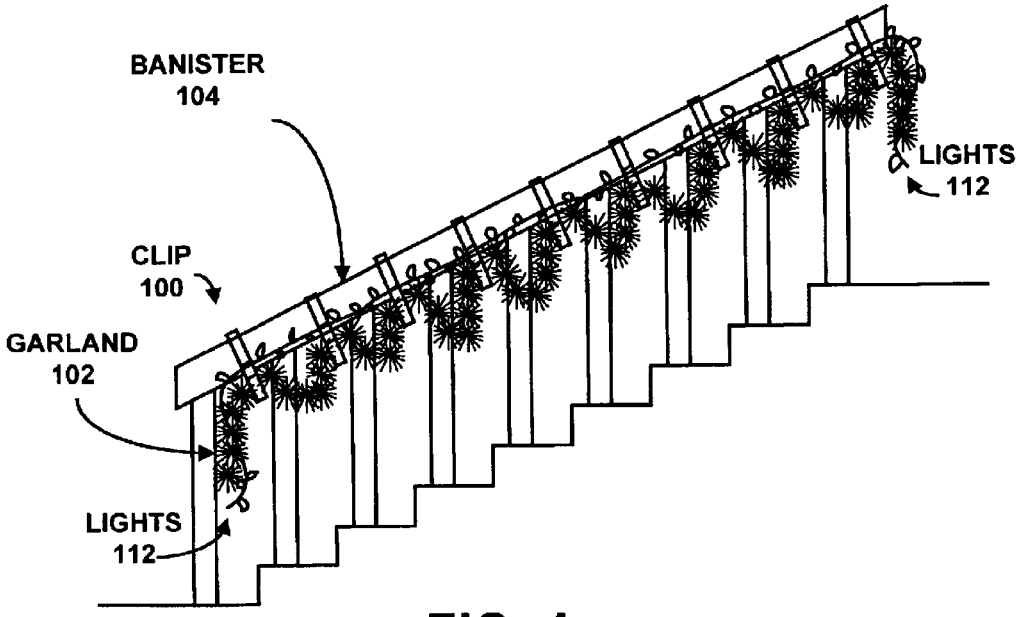
FIG. 4 is a schematic diagram illustrating garland set upon a banister via use of the clip of FIG. 3, wherein lights are arranged within the clip.

The clip 100 also contains a central loop portion 124 (FIG. 6) for running objects therein. As an example, lights 112 (FIG. 4) may be run through the central loop portion 124 (FIG. 6) of the clip 100. The central loop portion 124 (FIG. 6) may also hold objects therein, as is described below. FIG. 4 is a schematic diagram illustrating garland 102 set upon the banister 104 via use of the clip 100, wherein lights 112 are arranged within the clip 100. Specifically, the lights 112 are arranged within the central loop portion 124 (FIG. 6).

Figure 5:
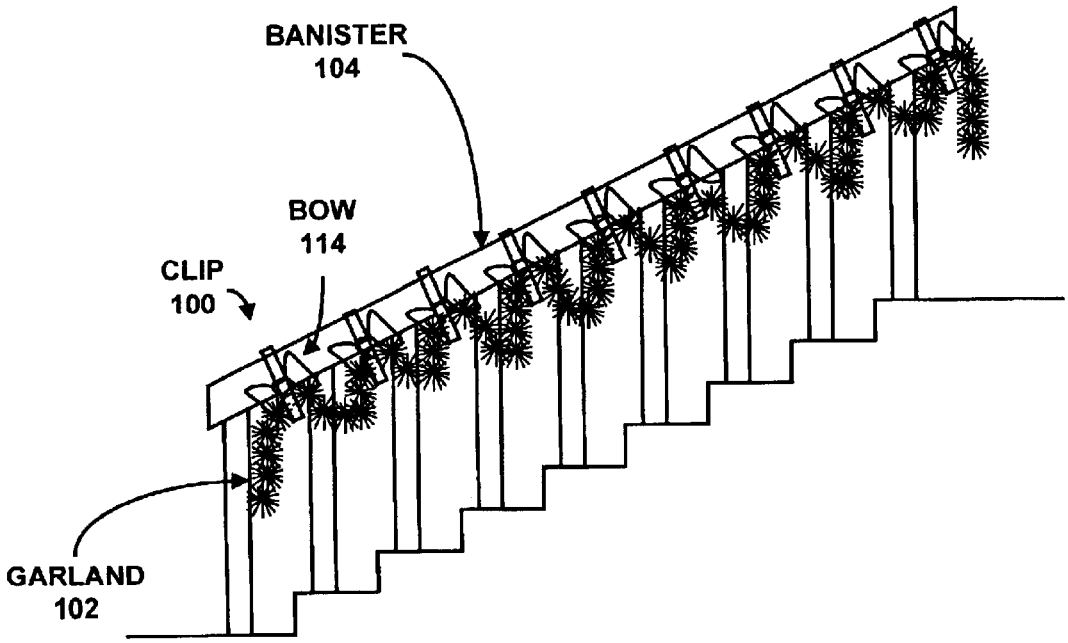
FIG. 5 is a schematic diagram illustrating garland set upon a banister via use of the clip of FIG. 3, wherein bows are arranged within the clip.

FIG. 5 provides a schematic diagram illustrating garland 102 set upon the banister 104 via use of the clip 100, wherein a bow 114 is arranged within each clip 100. Specifically, a bow 114 is arranged within the central loop portion 124 (FIG. 6) of each clip 100, in a manner similar to arrangement of the lights 112, as shown by FIG. 4. In fact, the central loop portion 124 (FIG. 6) of the clip 100 may be utilized to hold different objects that fit therein. FIG. 6, which is described in detail below, better illustrates the central loop portion 124 (FIG. 6) of the clip 100, as well as other portions of the clip 100.

Figure 6:
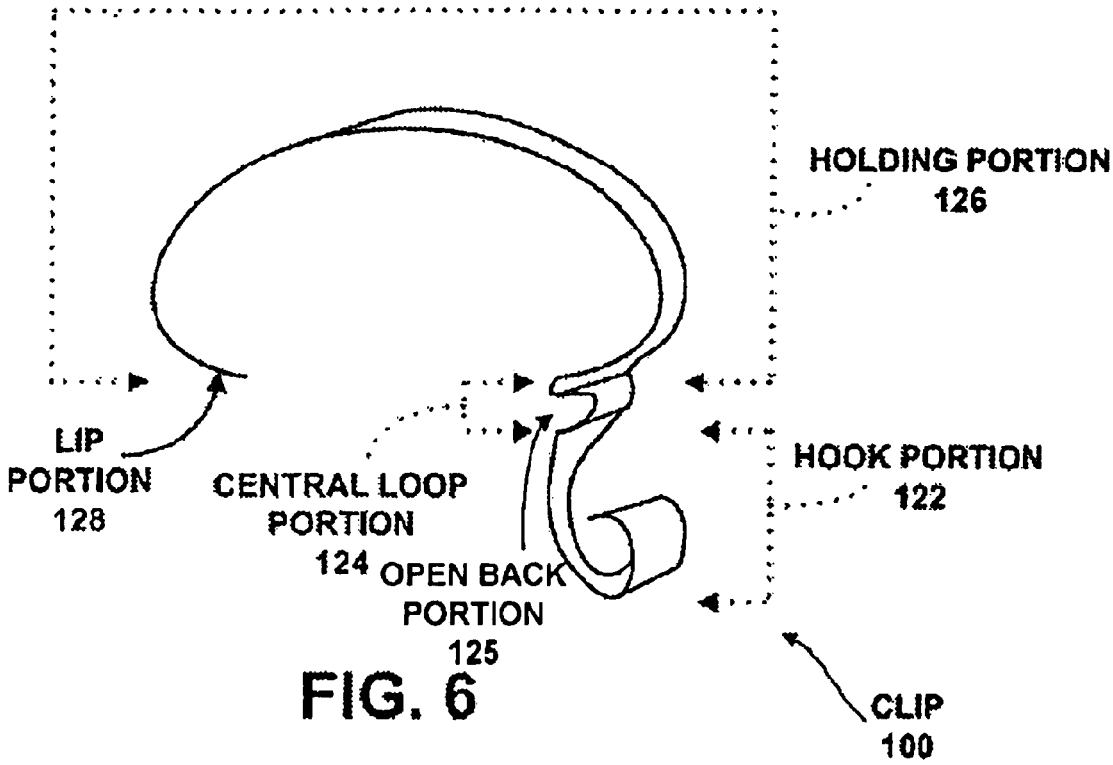
FIG. 6 is a side view of the clip of FIG. 3, in accordance with the first exemplary embodiment of the invention.
Figure 7:
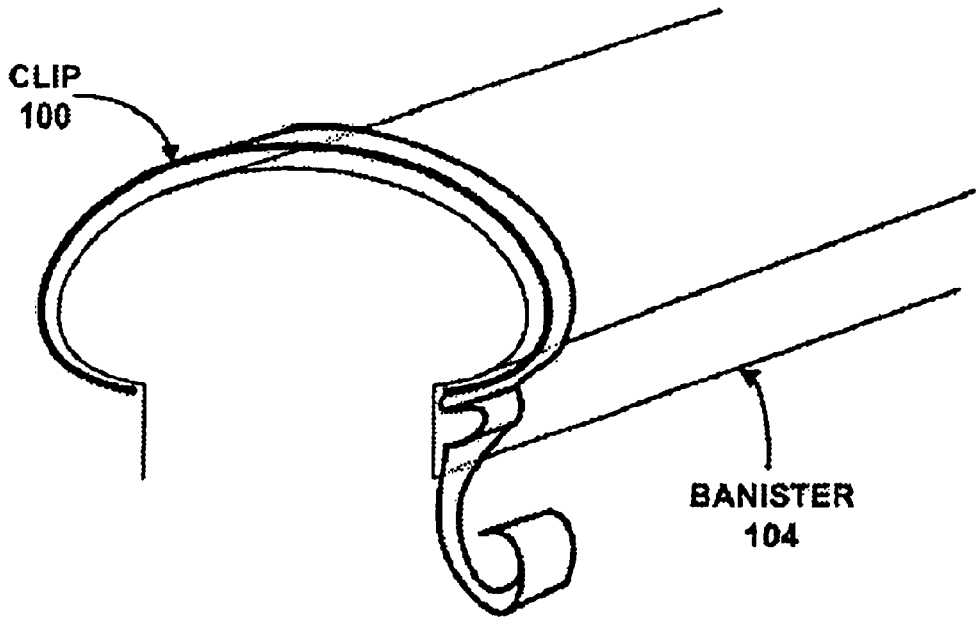
FIG. 7 is a side view of the clip of FIG. 6, wherein the clip is arranged on a banister.

Turning now to FIG. 6, the clip 100 contains the hook portion 122, the central loop portion 124, and a holding portion 126. In addition, the holding portion 126 further comprises a lip portion 128. The holding portion 126 of the clip 100 is shaped so as to conform to a structure, such as, but not limited to, the banister 104, thereby allowing the holding portion 126 to hold to the structure. Specifically, the holding portion 126 is flexible, yet sturdy enough to conform to its originally fabricated shape. Therefore, a force may be provided to the lip portion 128 of the holding portion 126 so as to flex the lip portion 128 in a direction away from the hook portion 122. The clip 100 may then be situated on the banister 102, as shown by FIG. 7. However, after the force is removed from the lip portion 128, the holding portion 126 conforms back to the originally fabricated shape so that the clip 100 holds to the banister 104. As an example, the entire holding portion 126 may fit snugly to the structure, wherein minimal space exists between the structure and the holding portion 126. Alternatively, a portion of the holding portion 126 may fit snugly to the structure, while other portions of the holding portion 126 have a minimal amount of space between the portions and the structure.

Figure 8:
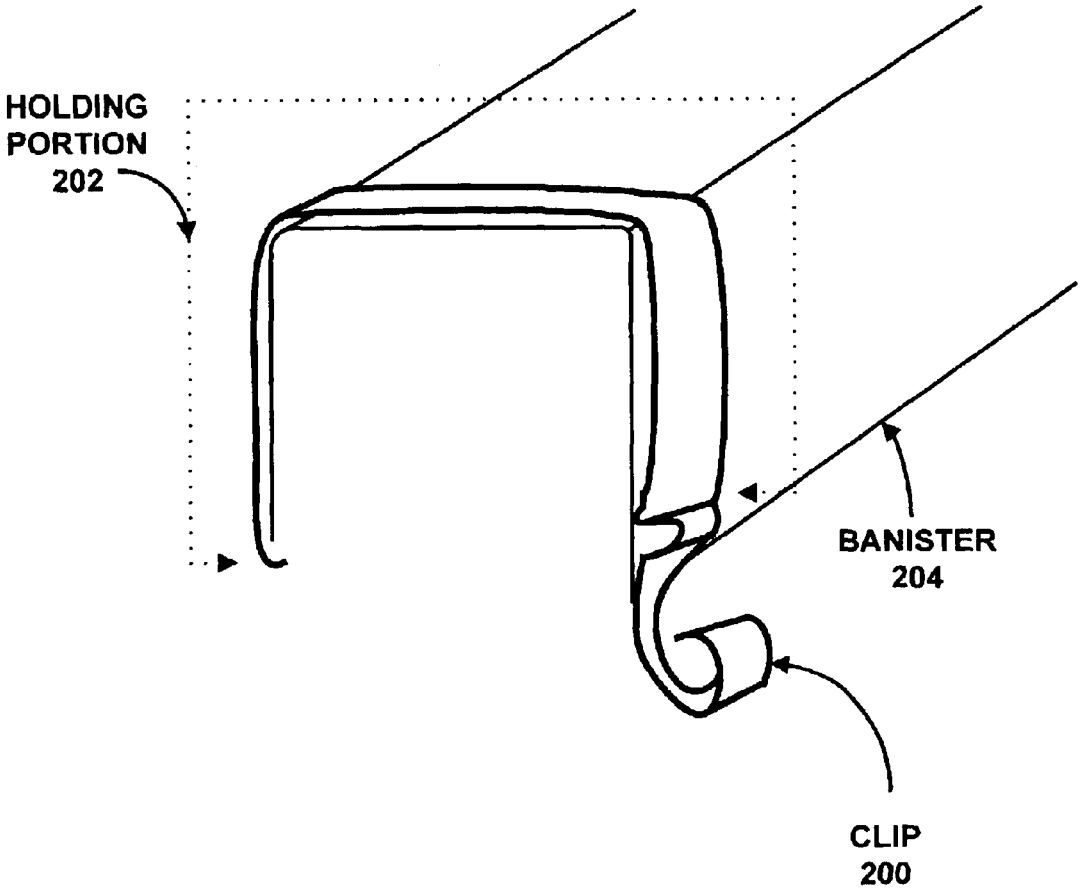
FIG. 8 is a side view of a clip in accordance with a second exemplary embodiment of the invention, wherein the clip is arranged on a banister.

The clip 100 may be made of different materials, such as, but not limited to, plastic and/or metal, as long as the holding portion 126 of the clip 100 may be flexed to allow a structure, such as the banister 104, to fit therein. It should be noted that the holding portion 126 of the clip 100 may also be shaped differently during fabrication so as to conform to the shape of the structure on which the clip 100 is to be set. As an example, FIG. 8 is a side view of a clip 200 in accordance with a second exemplary embodiment of the invention, wherein the clip 200 is set upon a banister 204. It should be noted that the banister 204 is square-like in shape. As is shown by FIG. 8, a holding portion 202 of the clip 200, in accordance with the second exemplary embodiment of the invention, is square-like in shape so as to allow the holding portion 202 of the clip 200 to hold the banister 204.

Figure 9:
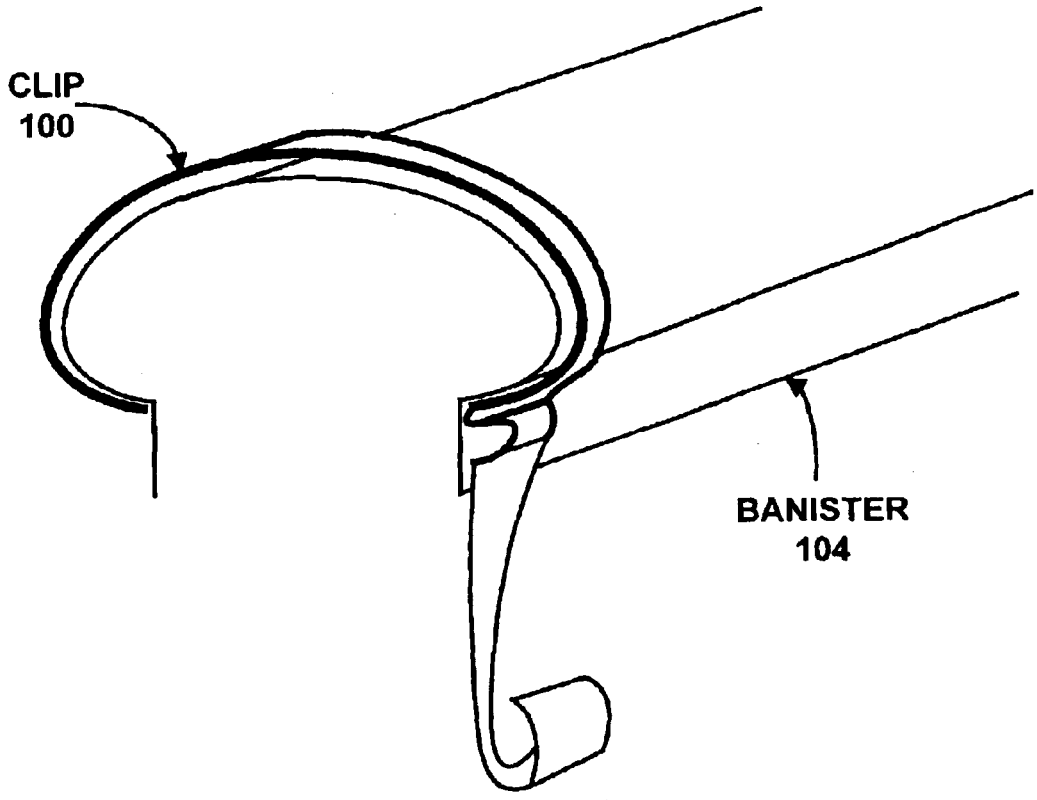
FIG. 9 is a side view of the clip of FIG. 7, wherein the clip has an elongated hook portion.

Returning to FIG. 6 and FIG. 7, the hook portion 122 of the clip 100 may be larger or smaller than the size illustrated by FIGS. 3–7. Specifically, the hook portion 122 may be fabricated to hold large ornamental objects or small ornamental objects on the clip 100. The size of the hook portion 122 may also be determined based upon a desired distance between the banister 104 and the garland 102 being hung. As an example, if the user of the clip 100 wishes for the garland 102 to be situated close to the banister 104, the clip 100 used by the user would have a short hook portion 122 (i.e., FIG. 7). Alternatively, if the user of the clip 100 wishes for the garland 102 to be a further distance to the banister 104, the clip 100 used by the user would have an elongated hook portion 122. FIG. 9 is a schematic diagram illustrating the clip 100 of FIG. 7, wherein the clip 100 has an elongated hook portion 122.

Returning to FIG. 6 and FIG. 7, during fabrication of the clip 100, the hook portion 122 may be fabricated so that a distance between the lip portion 128 and the central loop portion 124 is slightly smaller than the width of the banister 104 on which the clip 100 is to be set. Therefore, after setting the clip 100 on the banister 104, the clip 100 attempts to conform back to its originally fabricated shape, thereby providing enough pressure on the banister 104 so as to ensure that the clip 100 maintains its position on the banister 104.

After the clip 100 has been situated on the banister 104, the clip 100 may be removed by pulling the hook portion 122 of the clip 100 away from the banister 104 and then lifting upward. Alternatively, the user of the clip 100 may lift the hook portion 122 of the clip 100 upward to remove the clip 100 from the banister 104.

The central loop portion 124 of the clip 100 may be sized so as to allow larger or smaller objects to be fit therein, or run there through. As an example, as has been mentioned herein-above, lights may be run within the central loop portion 124. If lights are run within the central loop portion 124, the size (i.e., diameter) of the central loop portion 124 may be relatively small. Alternatively, if a large bow is to be set in the central loop portion 124, the size of the central loop portion 124 may be relatively large. It should be noted that the central loop portion 124 described herein-above has an open back portion 125 that allows an object, such as the lights, to be easily set therein.

Figure 10:
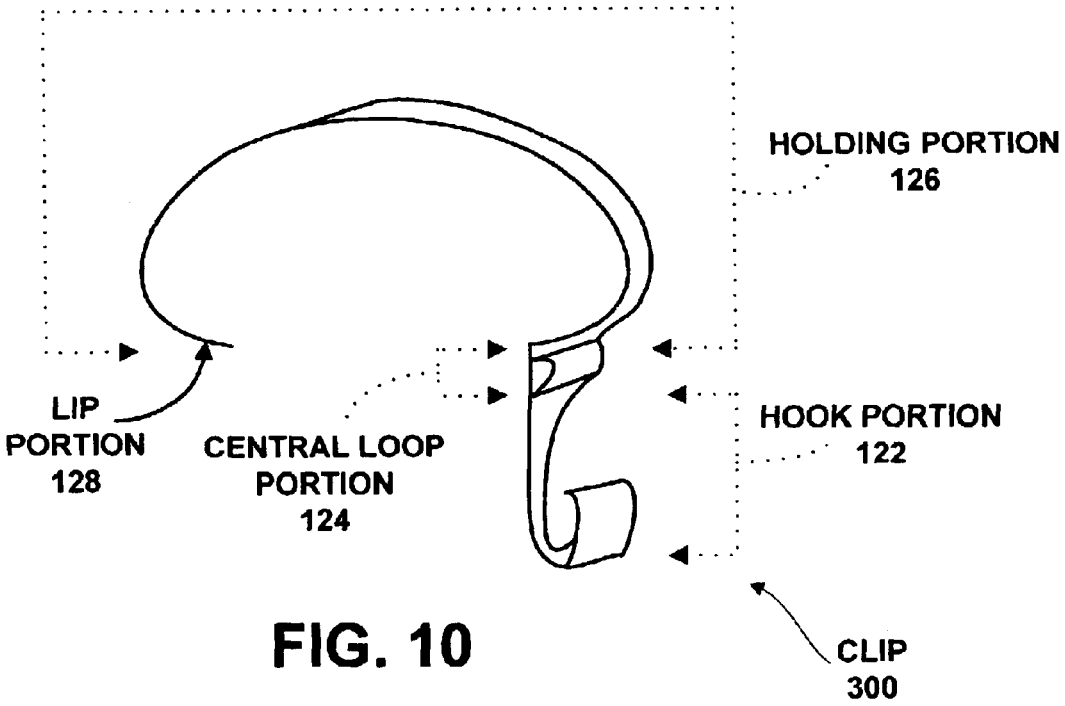
FIG. 10 is a side view of a clip in accordance with a third exemplary embodiment of the invention.

FIG. 10 is a side view of a clip 300 in accordance with the third exemplary embodiment of the invention. In accordance with a third exemplary embodiment of the invention, the central loop portion 124 does not have an open back portion.

Figure 11:
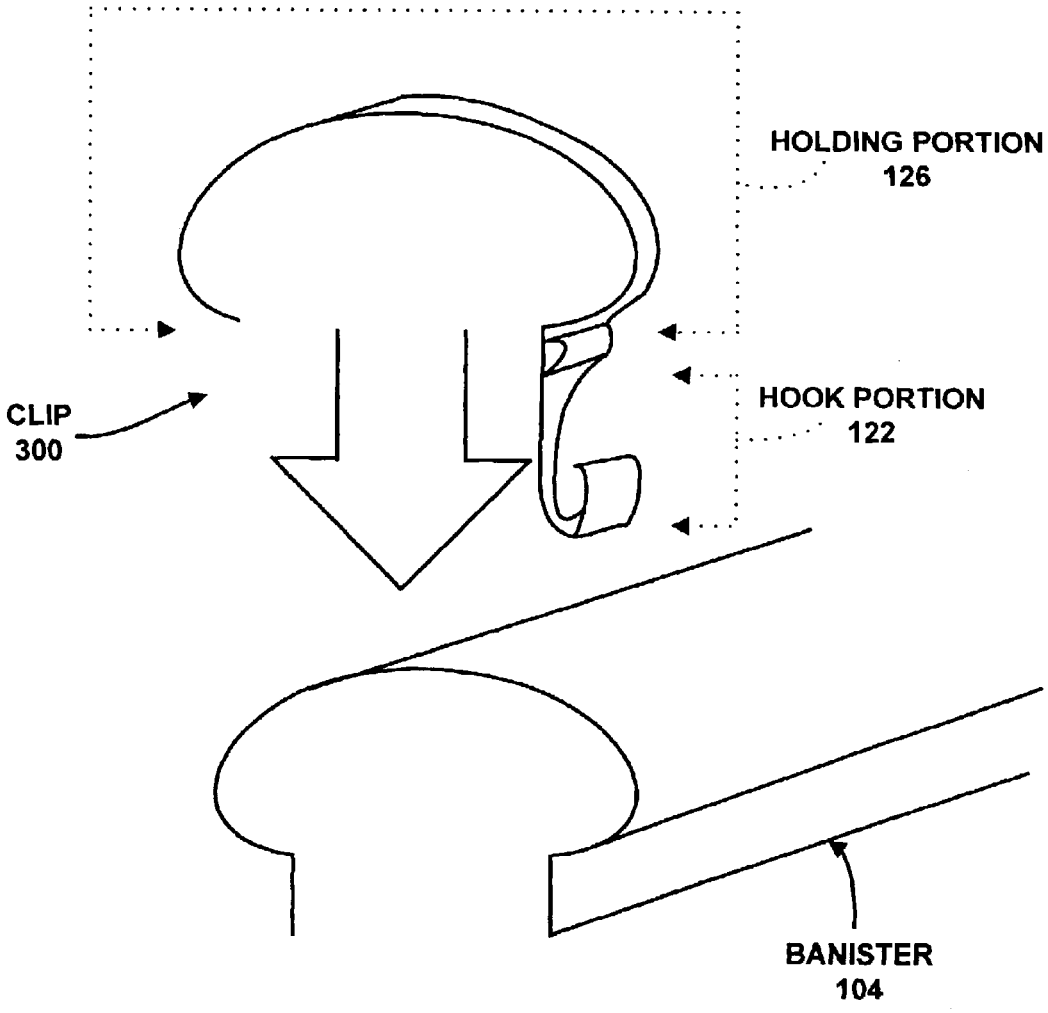
FIG. 11 is a schematic diagram illustrating a procedure for setting the clip of FIG. 10 on a banister.

FIG. 11 is a schematic diagram illustrating a procedure for setting the clip 300 of FIG. 10 on the banister 104. It should be noted that the procedure illustrated by FIG. 11 may be utilized to set any of the above-mentioned clips 100, 200 on the banister 104. As is shown by FIG. 11, the clip 300 is pushed downward, onto the banister 104. After contacting the banister 104, forcing the clip 300 downward results in the hook portion 122 and holding portion 126 widening to allow the banister 104 to sit therein. When the banister 104 is seated within the holding portion 126, the holding portion 126 holds to the banister 104, thereby preventing the clip 300 from sliding up and down the banister 104.

It should be noted that each clip demonstrated by the above-mentioned embodiments, contains a smooth inner portion, wherein it is the inner portion of a clip that touches a banister. The smooth inner portion prevents the banister from being scratched either during placing the clip on the banister, during removal of the clip from the banister, or while the clip sits on the banister.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

I claim:

1. An apparatus for displaying an object on a structure, comprising:

a holding portion fabricated so as to allow said apparatus to hold to said structure;

a hook portion capable of allowing said object to be set on said apparatus; and an enclosed central loop portion located between said holding portion and said hook portion, said enclosed central loop portion being entirely enclosed on a top portion, a bottom portion, a front portion, and a back portion of said enclosed central loop portion, and said enclosed central loop portion being open on a left side portion and a right side portion of said enclosed central loop portion, wherein said enclosed central loop portion is capable of allowing a second object to be situated in said enclosed central loop portion after being placed within said left side portion or said right side portion of said enclosed central loop portion, and said holding portion further comprising a lip portion that extends toward said back portion of said central loop portion, resistance between said portion and said back portion of said enclosed central loop portion causing said apparatus to hold to said structure, thereby limiting removal by an upward, vertical force and providing an easy manner of setting said apparatus on said structure by applying an outward, horizontal force to said lip portion while setting said apparatus around said structure.

2. The apparatus of claim 1, wherein said apparatus is fabricated from a shape conforming material so that said apparatus is flexed out of an original shape when a force is provided to said holding portion or said hook portion, and said apparatus returns to said original shape when said force is removed.

3. The apparatus of claim 1, wherein said central loop portion is in the shape or a ring.

4. The apparatus of claim 1, wherein said structure is a banister.

5. The apparatus of claim 1, wherein said holding portion has a shape similar to a shape of said structure, so that said holding portion fits snugly on said structure.

6. The apparatus of claim 5, wherein additional portions of said holding portion do not fit snugly on said structure.

7. The apparatus of claim 1, wherein said hook portion extends from said holding portion and wherein said hook portion does not contact said structure when said apparatus holds said structure.

8. An apparatus for displaying an object on a banister, comprising:

means for holding being fabricated so as to allow said apparatus to hold to said banister;

means for hanging being capable of allowing said object to hang from said apparatus; and means for maintaining a second object in said apparatus, said means for maintaining a second object in said apparatus being located between said means for holding and said means for hanging, wherein said means for maintaining is entirely enclosed on a top portion, a bottom portion, a front portion, and a back portion of said means for maintaining, and said means for maintaining being open on a left side portion and a right side portion of said means for maintaining, wherein said means for maintaining is capable of allowing a second object to be situated in said means for maintaining after being placed within said left side portion or said right side portion of said means for maintaining, and said means for holding further comprising a means for providing resistance, said means for providing resistance extending toward said back portion of said means for maintaining a second object, resistance between said means for providing resistance and said back portion of said means for maintaining a second object causing said apparatus to hold to said structure, thereby limiting removal by an upward, vertical force and providing an easy manner of setting said apparatus on said structure by applying an outward, horizontal force to said means for providing resistance while setting said apparatus around said structure.

9. The apparatus of claim 8, wherein said apparatus is fabricated from a shape conforming material so that said apparatus is flexed out of an original shape when a force is provided to said means for holding or said means for hanging, and said apparatus returns to said original shape when said force is removed.

10. The apparatus of claim 8, wherein said means for holding has a shape similar to a shape of said banister, so that said means for holding fits snugly on said banister.

11. The apparatus of claim 10, wherein additional portions of said means for holding do not fit snugly on said banister.

12. The apparatus of claim 8, wherein said means for hanging extends from said means for holding and wherein said means for hanging does not contact said banister when said apparatus holds said banister.

* * * * *

UNITED STATES PATENT AND TRADEMARK OFFICE

CERTIFICATE OF CORRECTION

PATENT NO. : 6,848,660 B2
DATED : February 1, 2005
INVENTOR(S) : Jeffrey Jackson It is certified that error appears in the above-identified patent and that said Letters Patent is hereby corrected as shown below:

Column 5,
Line 39, "between said portion and said back portion" should be -- between said lip portion and said back portion --.
Line 54, "in the shape or a ring" should be -- in the shape of a ring --.

Signed and Sealed this

Tenth Day of May, 2005

JON W. DUDAS
*Director of the United States Patent and Trademark Office*